US011183751B2

(12) United States Patent
Purden et al.

(10) Patent No.: US 11,183,751 B2
(45) Date of Patent: Nov. 23, 2021

(54) ANTENNA DEVICE WITH DIRECT DIFFERENTIAL INPUT USEABLE ON AN AUTOMATED VEHICLE

(71) Applicant: APTIV TECHNOLOGIES LIMITED, St. Michael (BB)

(72) Inventors: George J. Purden, Westlake Village, CA (US); Shawn Shi, Thousand Oaks, CA (US); David W. Zimmerman, Noblesville, IN (US)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 363 days.

(21) Appl. No.: 15/709,632

(22) Filed: Sep. 20, 2017

(65) Prior Publication Data

US 2019/0089042 A1 Mar. 21, 2019

(51) Int. Cl.

| | |
|---|---|
| ***H01P 5/107*** | (2006.01) |
| ***H01P 5/10*** | (2006.01) |
| ***H01Q 1/32*** | (2006.01) |
| ***H01Q 21/00*** | (2006.01) |
| ***H01Q 13/10*** | (2006.01) |

(Continued)

(52) U.S. Cl.

CPC ..... *H01Q 1/3283* (2013.01); *H01P 5/107* (2013.01); *H01Q 13/06* (2013.01); *H01Q 13/10* (2013.01); *H01Q 21/005* (2013.01); *H01P 3/121* (2013.01); *H01Q 1/3233* (2013.01); *H01Q 13/106* (2013.01)

(58) Field of Classification Search

CPC .... H01Q 1/3283; H01Q 1/3233; H01P 3/026; H01P 1/2013; H01P 5/107; H01P 3/121; H01P 5/10; H01P 5/1015; H01P 5/1022

See application file for complete search history.

(56) References Cited

U.S. PATENT DOCUMENTS 7,439,822 B2 * 10/2008 Shimura ..... H01P 5/08 333/26
8,441,405 B2 * 5/2013 Tsutsumi ..... H01Q 13/22 343/771

(Continued)

FOREIGN PATENT DOCUMENTS

GB 2 499 792 A 9/2013
JP HO8 148913 A 6/1996

(Continued)

OTHER PUBLICATIONS

Li Yujian, et al.: "60-GHz Dual-Ploarized Two-Dimensional Switch-Beam Wideband Antenna Array of Aperture-Coupled Magneto-Electric Dipoles". Feb. 1, 2016, pp. 554-563.

(Continued)

*Primary Examiner* — Dameon E Levi
*Assistant Examiner* — Jennifer F Hu
(74) *Attorney, Agent, or Firm* — Carlson, Gaskey & Olds

(57) ABSTRACT

An illustrative example transmission device, which is useful for an automated vehicle, includes a substrate having a metal layer near one surface of the substrate and a waveguide area. The metal layer includes a slot that at least partially overlaps the waveguide area. A source of radiation includes a first radiation output situated on a first side of the slot and a second radiation output situated on a second, opposite side of the slot.

21 Claims, 3 Drawing Sheets

(51) Int. Cl.
*H01Q 13/06* (2006.01)
*H01P 3/12* (2006.01)

(56) References Cited

U.S. PATENT DOCUMENTS

| | | | | |
|---|---|---|---|---|
| 8,854,152 | B2 * | 10/2014 | Uchimura | H01Q 23/00 333/21 R |
| 10,199,707 | B2 * | 2/2019 | Purden | H01P 5/08 |
| 2012/0242427 | A1 * | 9/2012 | Suzuki | H01P 5/107 333/250 |
| 2015/0364804 | A1 * | 12/2015 | Tong | G01S 7/032 342/175 |
| 2018/0108968 | A1 * | 4/2018 | Purden | H01P 5/08 |
| 2020/0287290 | A1 * | 9/2020 | Yao | H01Q 1/38 |

FOREIGN PATENT DOCUMENTS

| | | | | |
|---|---|---|---|---|
| JP | 2009 033526 | A | | 2/2009 |
| JP | 2009033526 | A | * | 2/2009 |
| JP | 4854622 | B2 | | 1/2012 |

OTHER PUBLICATIONS

European Search Report for Application No. 18194839.9, European Patent Office, dated Feb. 6, 2019.
English Abstract Translation of JP4854622B2, published Jan. 18, 2012.

* cited by examiner

ANTENNA DEVICE WITH DIRECT DIFFERENTIAL INPUT USEABLE ON AN AUTOMATED VEHICLE

BACKGROUND

Radar and other detection systems have a variety of uses. More recently, automotive vehicles have included increasing amounts of detection technology that utilizes radar signaling or principles for detecting objects in the vicinity or pathway of a vehicle.

There are a variety of configurations of antennas for vehicle sensor devices. Some include a substrate integrated waveguide (SIW) on a printed circuit board. Various techniques have been proposed to couple the radiated energy or signal into the SIW. One proposal that is useful for differential radio frequency signals includes coupling the differential radio frequency signal terminals to a balun to establish a single-ended output. That output can be coupled to a single-ended microstrip, which in turn can be coupled with the SIW.

The transition between the balun and the microstrip and the transition between the microstrip and the SIW each introduce a loss of power and limit bandwidth. Improved performance is desirable without such transition-induced losses.

SUMMARY

An illustrative example transmission device includes a substrate having a metal layer near one surface of the substrate and a waveguide area in the substrate. The metal layer includes a slot that at least partially overlaps the waveguide area. A source of radiation includes a first source output situated on a first side of the slot and a second source output situated on a second, opposite side of the slot.

In an example embodiment having one or more features of the transmission device of the previous paragraph, the first and second source outputs are coupled to the waveguide area to provide the radiation directly into the waveguide area.

In an example embodiment having one or more features of the transmission device of any of the previous paragraphs, the slot is situated offset from a center of the waveguide area.

In an example embodiment having one or more features of the transmission device of any of the previous paragraphs, the radiation comprises radio frequency radiation and the radio frequency radiation radiates outward from the waveguide area of the substrate.

In an example embodiment having one or more features of the transmission device of any of the previous paragraphs, the slot has a first portion oriented in a first direction and a second portion oriented in a second direction.

In an example embodiment having one or more features of the transmission device of any of the previous paragraphs, the first direction is transverse to the second direction.

In an example embodiment having one or more features of the transmission device of any of the previous paragraphs, the first direction is perpendicular to the second direction.

In an example embodiment having one or more features of the transmission device of any of the previous paragraphs, the source of radiation comprises a ball grid array, the first source output comprises a first ball of the ball grid array, and the second source output comprises a second ball of the ball grid array.

In an example embodiment having one or more features of the transmission device of any of the previous paragraphs, the slot has a length that corresponds to one-half a wavelength of the radiation.

In an example embodiment having one or more features of the transmission device of any of the previous paragraphs, the slot has a dimension that establishes a resonant frequency of the radiation in the waveguide area.

In an example embodiment having one or more features of the transmission device of any of the previous paragraphs, the metal layer defines an outer surface of one side of the substrate, the metal layer has a thickness, and the slot has a depth that is equal to the thickness.

An example embodiment having one or more features of the transmission device of any of the previous paragraphs includes a solder mask between the metal layer and the source of radiation, the solder mask including a first source solder pad on the first side of the slot and a second source solder pad on the second side of the slot.

An illustrative example method of making a transmission device includes establishing a slot in a metal layer on a first surface of a substrate overlapping a waveguide area of the substrate, situating a first output of a source of radiation on a first side of the slot, situating a second output of the source of radiation on a second side of the slot, and establishing a connection between the first and second outputs and the waveguide area of the substrate that facilitates the source providing the radiation directly into the waveguide area.

An example embodiment having one or more features of the method of the previous paragraph includes situating the slot in a position that is offset from a center of the waveguide portion.

An example embodiment having one or more features of the method of any of the previous paragraphs includes providing the slot with a first portion oriented in a first direction and a second portion oriented in a second, different direction.

In an example embodiment having one or more features of the method of any of the previous paragraphs, the first direction is perpendicular to the second direction.

An example embodiment having one or more features of the method of any of the previous paragraphs includes providing the slot with a length that establishes a resonant frequency of radiation emitted by the waveguide portion.

An example embodiment having one or more features of the method of any of the previous paragraphs includes providing the slot with a length that corresponds to one-half a wavelength of the radiation.

Another illustrative example method of operating a transmission device includes directly coupling radiation from first and second outputs into a waveguide area of a substrate by establishing an electromagnetic field between the first and second outputs across a slot in a metal layer of the substrate where the slot overlaps the waveguide area.

In an example embodiment having one or more features of the method of the previous paragraph, the radiation comprises differential radio frequency radiation.

Various features and advantages of at least one disclosed example embodiment will become apparent to those skilled in the art from the following detailed description. The drawings that accompany the detailed description can be briefly described as follows.

DETAILED DESCRIPTION

Embodiments of this invention provide signaling or detecting devices that are useful, for example, on vehicles that include a differential radiation source and a substrate integrated waveguide (SIW) transmitter with improved power and bandwidth characteristics. Such devices include a slot between radiation source outputs. The slot facilitates directly coupling radiation from the source into the waveguide.

Figure 1:
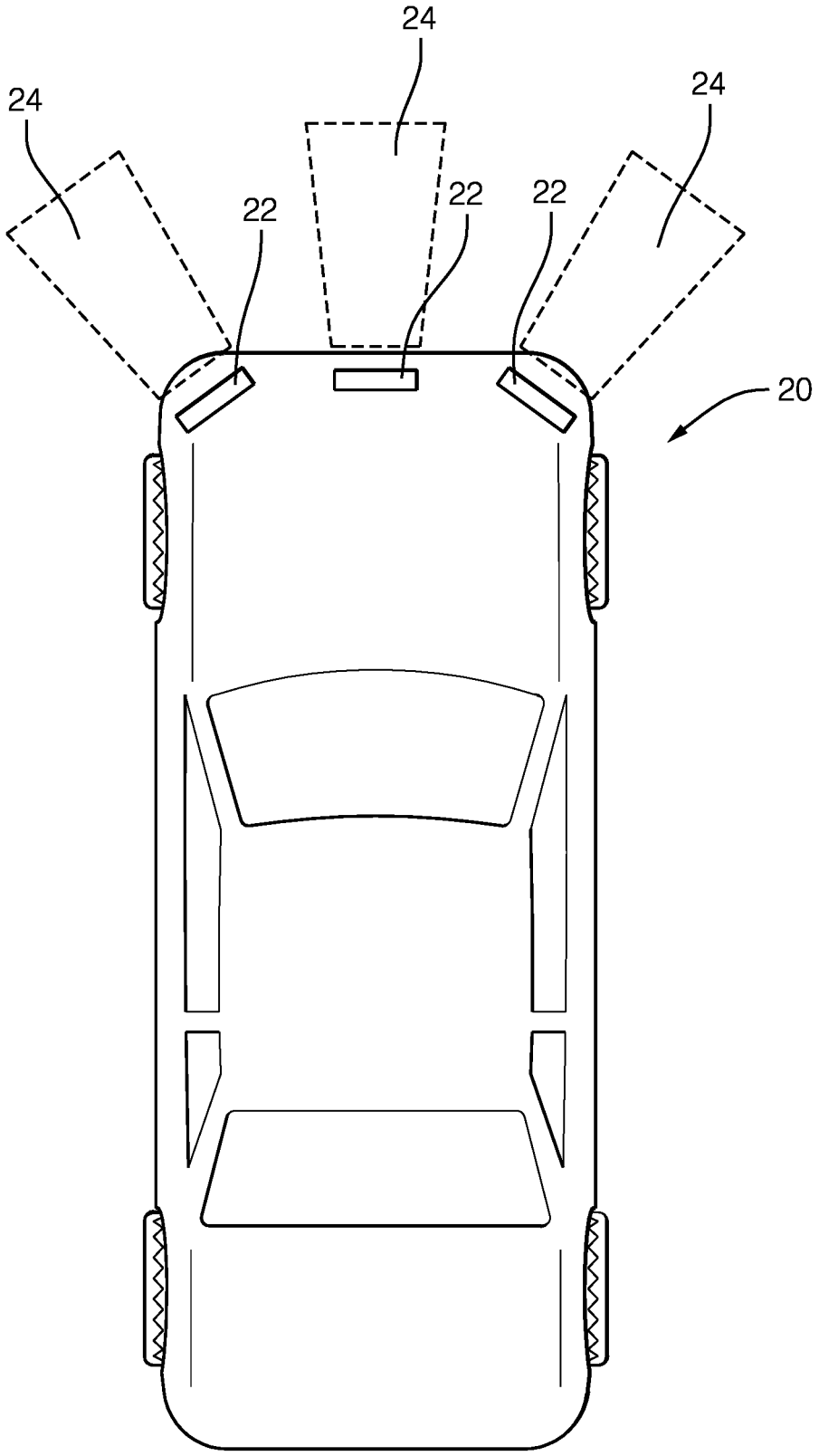
FIG. 1 schematically illustrates a vehicle including transmission devices designed according to an embodiment of this invention.

FIG. 1 schematically illustrates an example vehicle 20 that has transmission devices 22 supported on the vehicle. The transmission devices 22 respectively emit radiation, which may be referred to as a signal or signaling, as schematically shown at 24 in a selected direction and at a selected orientation relative to the vehicle 20. The radiation may be used for a variety of detecting purposes, such as detecting objects in a pathway or vicinity of the vehicle or to enable automated or semi-autonomous vehicle control. The example arrangement of transmission devices is shown for discussion purposes and those skilled in the art will realize an arrangement or position of one or more such devices to meet their particular needs.

Figure 2:
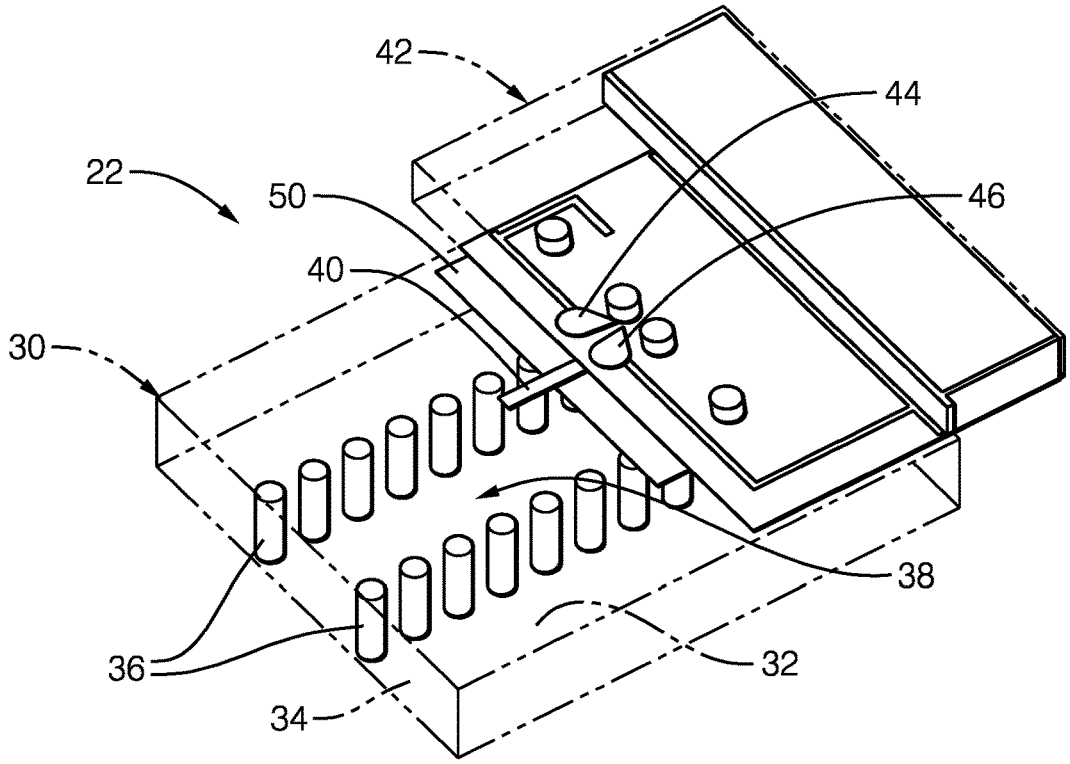
FIG. 2 schematically illustrates selected features of a transmission device designed according to an embodiment of this invention.
Figure 3:
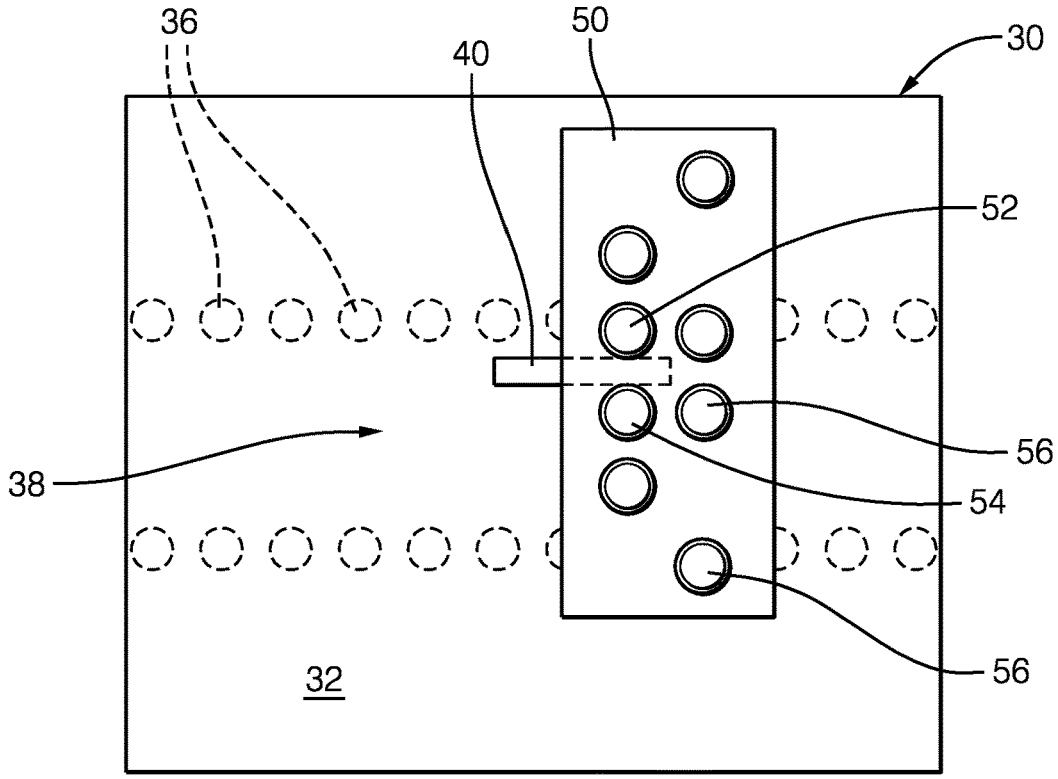
FIG. 3 is an elevational view of the embodiment of FIG. 2 schematically illustrating selected features of that embodiment.

FIGS. 2 and 3 schematically illustrate selected portions of an example transmission device 22. In this example, a substrate 30 has a metal layer 32 near one surface of the substrate 30. In this example, the metal layer 32 defines an outer surface or layer of the substrate 30.

The substrate body 34 includes a plurality of electrically conductive vias 36 arranged to establish a waveguide area 38 in the substrate 30. In this example the waveguide area 38 is a SIW.

The example transmission device 22 includes a slot 40 in the metal layer 32. The slot 40 at least partially overlaps the waveguide area 38. In this example the entire slot 40 is situated in an overlapping relationship with the waveguide area.

A source of radiation or signaling energy 42 includes a first source output 44 situated on one side of the slot 40 and a second source output 46 situated on an opposite side of the slot. Having the slot 40 between the source outputs 44 and 46 allows for establishing an electromagnetic field between the outputs across the slot 40. The slot 40 facilitates directly coupling energy or radiation from the source outputs 44 and 46 directly into the waveguide area 38. Such a direct coupling eliminates any transitions between the source and intermediate connectors such as microstrips that might otherwise be required to couple the radiation from the source to the waveguide area 38. The direct coupling provided by the example embodiment reduces or eliminates power loss and lessens or removes limits on bandwidth that otherwise would exist with intermediate connectors.

In this example, the source 42 comprises a ball grid array source that provides differential radio frequency radiation or energy. The first output 44 and the second output 46 are the positive and negative outputs of the differential radiation. The slot 40 and the outputs 44 and 46 on opposite sides of the slot 40 makes it possible to directly couple such radiation directly into the waveguide area 38. One feature of embodiments of this invention is that they are effective and efficient at handling the positive and negative signal balancing for a differential radio frequency signal, which has otherwise been difficult or challenging.

Figure 4:
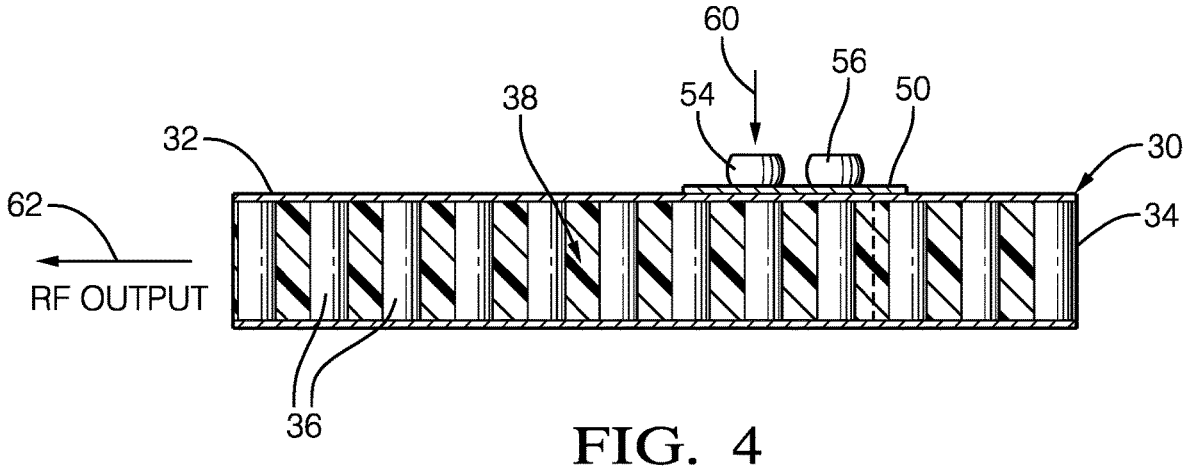
FIG. 4 is another view of that embodiment.

As best appreciated from FIGS. 3 and 4, the example transmission device 22 includes a solder mask 50 situated on the metal layer 32. The solder mask 50 includes a first soldering connection 52 on one side of the slot 40 and a second soldering connection 54 on an opposite side of the slot 40. The soldering connections 52 and 54 in this example comprise solder balls that are situated to make an electrically conductive connection with the first output 44 and the second output 46, respectively, of the source 42. Other soldering connections (e.g., solder balls) 56 facilitate other connections, such as ground. The solder mask 50 facilitates mounting the ball grid array source 42 directly onto the substrate 30.

As schematically shown by the arrow 60 in FIG. 4, radiation or energy from the source 42 enters the waveguide area 38 through the connections 52 and 54 as an electromagnetic field across the slot 40 couples the radiation into the waveguide area. The SIW of the substrate 30 emits radiation or signaling as schematically shown by the arrow 62. In embodiments that include a differential radio frequency source 42, the output from the SIW is an RF output.

The slot 40 has a length that is selected to establish a resonant frequency of the radiation in the waveguide area 38. The length of the slot 40 in this example corresponds to one-half a wavelength of the radiation.

The slot 40 is offset from a center of the waveguide area 38 to maximize the energy or radiation transferred or radiated into the waveguide area 38. The position of the slot 40 may be selected in various embodiments to tune the transmission device to meet the needs of a particular implementation. Those skilled in the art who have the benefit of this description will realize the precise offset position of the slot 40 to meet their needs.

Selecting the slot length and position compensates for die output impedance or circuit discontinuities, for example.

Figure 5:
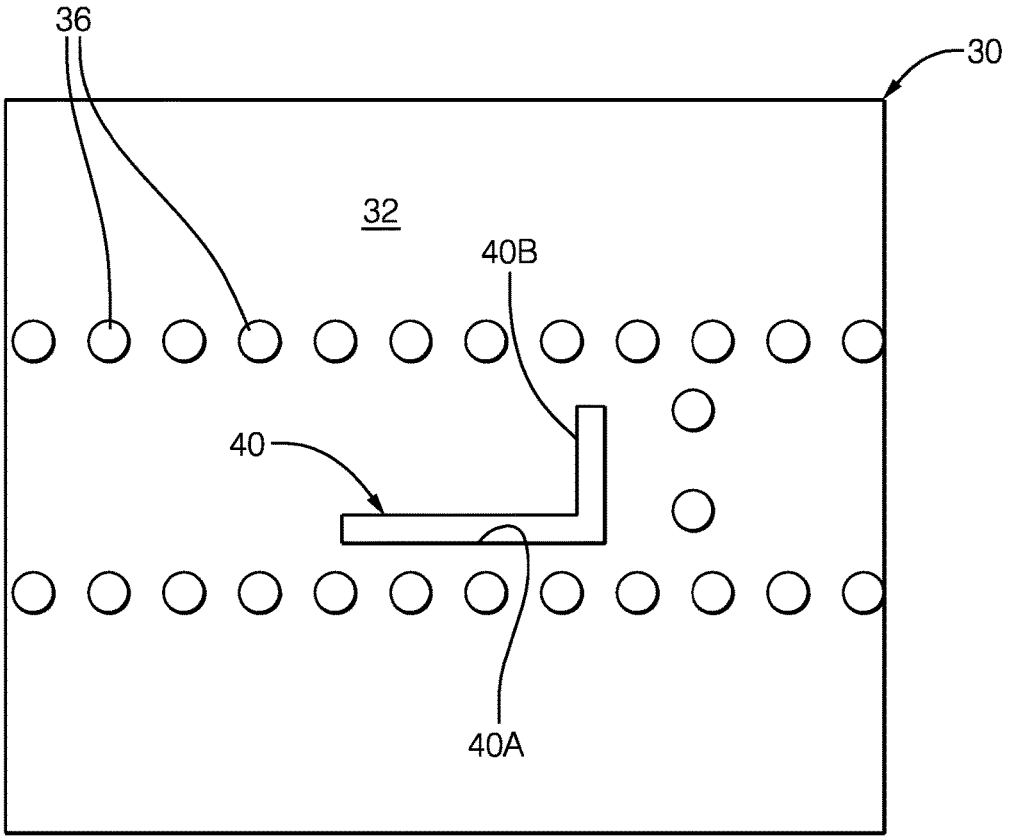
FIG. 5 schematically illustrates selected features of another transmission device designed according to an embodiment of this invention.

FIG. 5 schematically illustrates another example embodiment. In this example, the slot 40 includes a first portion 40A oriented in a first direction and a second portion 40B oriented in a second, different direction. The second direction is transverse to the first direction and, in particular for this embodiment, is perpendicular to the first direction. Having portions of the slot oriented in different directions allows for realizing a desired length of the slot 40 while accommodating various connection locations on the solder mask 50 (not shown in FIG. 5). For example, it is not possible to utilize any soldering connections that are immediately adjacent to the slot 40 for other purposes, such as grounding. With a slot having multiple portions oriented in multiple directions, the slot can be configured to fit within the packaging constraints of the substrate 30 and the solder mask 50 in a way that increases the possibilities for configuring or utilizing features of the substrate 30 or the source 42.

The features represented in the drawings and described above are discussed in connection with a particular embodiment but they are not necessarily limited to that embodiment. Combinations of one or more features from one embodiment with one or more from another embodiment are possible to realize other embodiments.

The preceding description is exemplary rather than limiting in nature. Variations and modifications to disclosed examples may become apparent to those skilled in the art that do not necessarily depart from the essence of this invention. The scope of legal protection given to this invention can only be determined by studying the following claims.

We claim:

1. A transmission device, comprising:

a substrate having a metal layer near one surface of the substrate and a waveguide area in the substrate, the metal layer including a slot that at least partially overlaps the waveguide area; and a component mounted on the substrate with one side facing the metal layer, the component including a source of radiation, the source of radiation including a first source output on the one side of the component and a second source output on the one side of the component, the first source output being situated on a first side of the slot, the second source output being situated on a second, opposite side of the slot, each of the first and second source outputs outputting radiation from the source that establishes an electromagnetic field between the first and second source outputs such that the radiation from the source is coupled into the waveguide area through the slot.

2. The transmission device of claim 1, wherein the radiation comprises differential radio frequency radiation, the first source output is a positive output of the differential radio frequency radiation, and the second source output is a negative output of the differential radio frequency radiation.

3. The transmission device of claim 1, wherein the one side of the component overlaps at least a portion of the slot and the first and second source outputs are on opposites sides of the portion of the slot.

4. The transmission device of claim 3, wherein the component comprises a ball grid array at least partially on the one side of the component;

the first source output comprises a first ball of the ball grid array; and the second source output comprises a second ball of the ball grid array.

5. The transmission device of claim 1, wherein the slot is situated offset from a center of the waveguide area.

6. The transmission device of claim 1, wherein the radiation comprises radio frequency radiation; and the radio frequency radiation radiates outward from the waveguide area of the substrate.

7. The transmission device of claim 1, wherein the slot has a first portion oriented in a first direction and a second portion oriented in a second direction that is transverse to the first direction.

8. The transmission device of claim 7, wherein the first direction is perpendicular to the second direction.

9. The transmission device of claim 1, wherein the slot has a length that corresponds to one-half a wavelength of the radiation.

10. The transmission device of claim 1, wherein the slot has a dimension that establishes a resonant frequency of the radiation in the waveguide area.

11. The transmission device of claim 1, wherein the metal layer defines an outer surface of one side of the substrate;

the metal layer has a thickness; and the slot has a depth that is equal to the thickness.

12. The transmission device of claim 1, comprising a solder mask between the metal layer and the one side of the component, the solder mask including a first source solder pad on the first side of the slot and a second source solder pad on the second side of the slot.

13. A method of making the transmission device of claim 1, the method comprising:

establishing the slot in a metal layer on a first surface of the substrate at least partially overlapping the waveguide area of the substrate;

situating the first output of the source of radiation on the first side of the slot; and situating the second output of the source of radiation on the second side of the slot.

14. The method of claim 13, comprising situating the slot in a position that is offset from a center of the waveguide area.

15. The method of claim 13, comprising providing the slot with a first portion oriented in a first direction and a second portion oriented in a second, different direction.

16. The method of claim 15, wherein the first direction is perpendicular to the second direction.

17. The method of claim 13, comprising providing the slot with a length that establishes a resonant frequency of radiation emitted by the waveguide area.

18. The method of claim 13, comprising providing the slot with a length that corresponds to one-half a wavelength of the radiation.

19. The transmission device of claim 1, wherein the radiation is directly coupled into the waveguide area from the first and second source outputs through the slot.

20. The transmission device of claim 1, wherein the radiation is directly coupled into the waveguide area independent of any intermediate line connectors between the first and second source outputs and the slot.

21. The transmission device of claim 1, wherein the first source output and the second source output are outside of the substrate.

* * * * *